US006707918B1

(12) United States Patent
McGrath et al.

(10) Patent No.: US 6,707,918 B1
(45) Date of Patent: Mar. 16, 2004

(54) FORMULATION OF COMPLEX ROOM IMPULSE RESPONSES FROM 3-D AUDIO INFORMATION

(75) Inventors: David Stanley McGrath, Bondi (AU); Adam Richard McKeag, Blakehurst (AU)

(73) Assignee: Lake Technology Limited, Ultimo (AU)

( * ) Notice: Subject to any disclaimer, the term of this patent is extended or adjusted under 35 U.S.C. 154(b) by 0 days.

(21) Appl. No.: 09/647,755

(22) PCT Filed: Mar. 31, 1999

(86) PCT No.: PCT/AU99/00240

§ 371 (c)(1),
(2), (4) Date: Jan. 2, 2001

(87) PCT Pub. No.: WO99/51062

PCT Pub. Date: Oct. 7, 1999

(30) Foreign Application Priority Data

Mar. 31, 1998 (AU) ..... PP 2708
Mar. 31, 1998 (AU) ..... PP 2713

(51) Int. Cl.[7] ..... H04R 29/00

(52) U.S. Cl. ..... 381/58; 381/59; 381/17

(58) Field of Search ..... 381/58, 59, 56, 381/57, 310, 17, 18; 73/586, 587

(56) References Cited

U.S. PATENT DOCUMENTS

| | | | | |
|---|---|---|---|---|
| 5,483,623 A | | 1/1996 | Nagashima | |
| 5,544,249 A | * | 8/1996 | Opitz | 381/63 |
| 5,596,644 A | | 1/1997 | Abel et al. | |
| 5,802,180 A | | 9/1998 | Abel et al. | |
| 5,812,674 A | * | 9/1998 | Joe et al. | 381/17 |

* cited by examiner

*Primary Examiner*—Melur Ramakrishnaiah
(74) *Attorney, Agent, or Firm*—Dov Rosenfeld; Inventek

(57) ABSTRACT

A method for the creation of acoustic impulse responses for utilization in rendering to an array of speakers comprising the steps of measuring a room response function; extracting a series of discrete time arrivals from the measured room response function so as to have a reverberant residual response function; separately rendering the extracted series and the reverberant residual response function to the array of speakers to form a discrete response and a residual response; combining the discrete response and the residual response to form an acoustic impulse response for the array of speakers.

5 Claims, 6 Drawing Sheets

FORMULATION OF COMPLEX ROOM IMPULSE RESPONSES FROM 3-D AUDIO INFORMATION

FIELD OF THE INVENTION

The present invention relates to the utilization of sound spatialization in audio signals.

BACKGROUND OF THE INVENTION

The use of B-format measurements, recordings and playback in the provision of more ideal acoustic reproductions which capture part of the spatial characteristics of an audio reproduction are well known.

In the case of conversion of B-format signals to multiple loudspeakers in a speaker array, there is a well recognized problem due to the spreading of individual virtual sound sources over a large number of playback speaker elements. In the worst case, this can lead to significant errors in a listener's localization of these virtual sound sources, especially if the listener is situated off-center in the speaker array. Likewise, in the case of binaural playback of B-format signals, the approximations inherent in the B-format soundfield can lead to less precise localization of sound sources, and a loss of the out-of-head sensation that is an important part of the binaural playback experience.

SUMMARY OF THE INVENTION

It is an object of the present invention to provide for an improved form of creation of impulse response models.

In accordance with a first aspect of the present invention, there is provided a method for the creation of acoustic impulse responses for utilization in rendering to an array of speakers comprising the steps of: measuring a room response function; extracting a series of discrete time arrivals from the measured room response function so as to leave a reverberant residual response function; separately rendering the extracted series and the reverberant residual response function to the array of speakers to form a discrete response and a residual response; combining the discrete response and the residual response to form an acoustic impulse response for the array of speakers.

The measuring step preferably can include measuring the room response function in a B-format.

The extraction step preferably can include extracting a direction and magnitude of each of the discrete time arrivals.

BRIEF DESCRIPTION OF THE DRAWINGS

Notwithstanding any other forms which may fall within the scope of the present invention, preferred forms of the invention will now be described, by way of example only, with reference to the accompanying drawings in which.

DESCRIPTION OF PREFERRED AND OTHER EMBODIMENTS

In discussion of the embodiments of the present invention, it is assumed that the input sounds and impulse response functions have a three dimensional characteristics and is in an "ambisonic B-format". It should be noted however that the present invention is not limited thereto and can be readily extended to other formats such as SQ, QS, UMX, CD-4, Dolby MP, Dolby surround AC-3, Dolby Pro-logic, Lucas Film THX etc.

The ambisonic B-format system is a very high quality sound positioning system which operates by breaking down the directionality of the sound into spherical harmonic components termed W, X, Y and Z. The ambisonic system is then designed to utilise all output speakers to cooperatively recreate the original directional components.

For a description of the B-format system, reference is made to:

(1) The Internet ambisonic surround sound FAQ available at the following HTTP locations.

http://www.omg.unb.ca/~mleese/ http://www.york.ac.uk/inst/mustech/3d_audio/ambison.htm http://jrusby.uoregon.edu/mustech.htm The FAQ is also available via anonymous FTP from pacific.cs.unb.ca in a directory/pub/ambisonic. The FAQ is also periodically posted to the Usenet newsgroups mega.audio.tech, rec.audio.pro, rec.audio.misc, rec.audio.opinion.

(2) "General method of theory of auditory localisation", by Michael A Gerzon, 90 sec, Audio Engineering Society Convention, Vienna 24th–27th March 1992.

(3) "Surround Sound Physco Acoustics", M. A. Gerzon, Wireless World, December 1974, pages 483–486.

(4) U.S. Pat. Nos. 4,081,606 and 4,086,433.

The preferred embodiment makes use of a convenient, measurement method (a soundfield microphone, used to measure B-format impulse responses) as a means for constructing accurate acoustic impulse responses for use in multiple-speaker or binaural playback environments.

Figure 1:
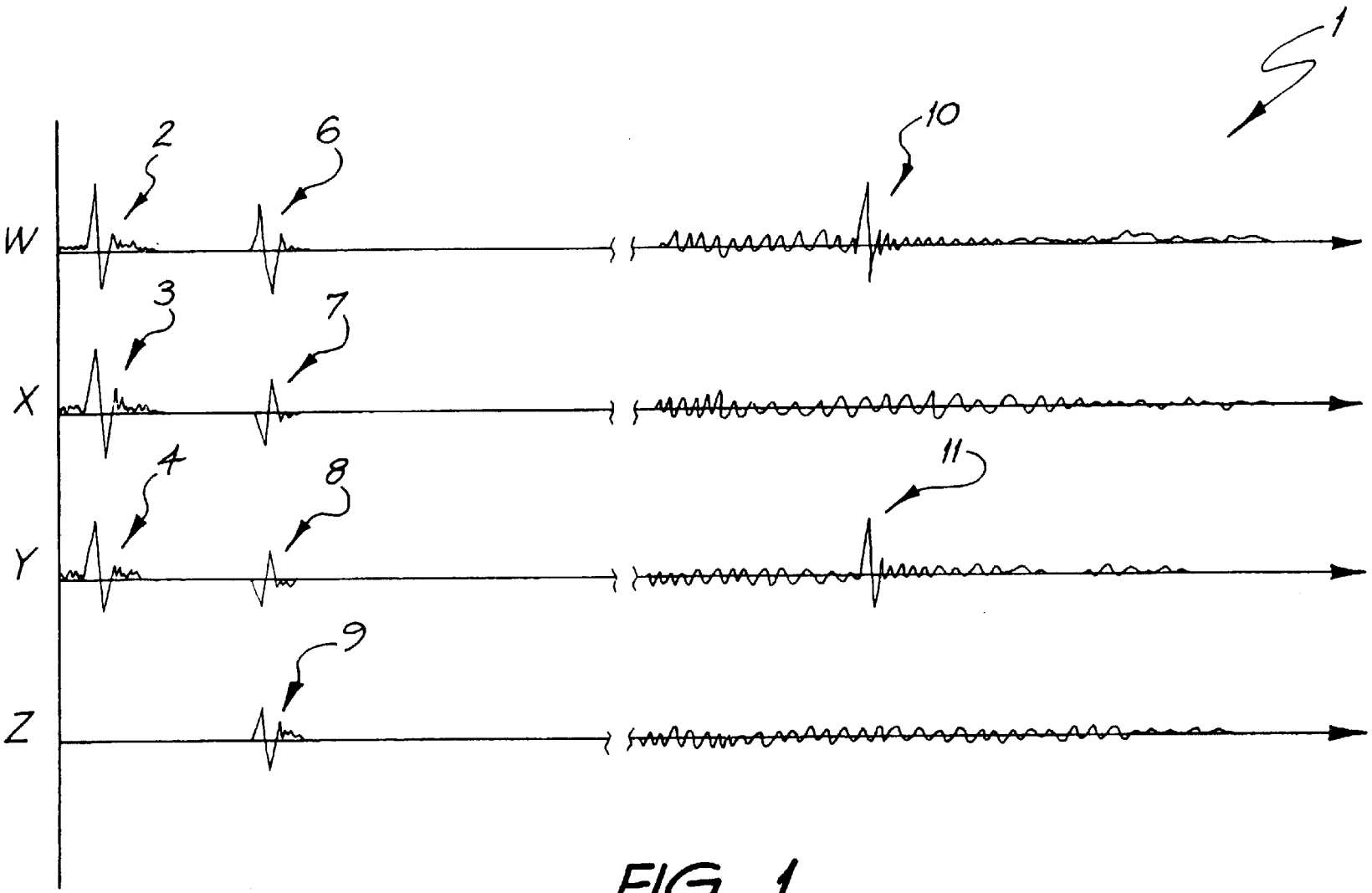
FIG. 1 illustrates a simplified B-format impulse response.

The new technique makes use of the fact that, in the early part of the impulse response of an acoustic space, discrete sound arrivals (individual echoes) can be separately identified and isolated. FIG. 1 shows the early part of a typical B-format impulse response 1 having w, x, y, z components. The direct sound appears as a large peak 2 in the W (omni) channel and corresponding positive, negative or zero peaks in the X,Y and Z channels eg. 3, 4 indicate the direction of arrival of this direct sound. Likewise, several later sound arrivals (echoes in the acoustic space) can also be separately isolated 6–9, and their amplitude, time delay, and direction of arrival can be determined.

As part of the reverberant tail, several other peaks eg. 10, 11 may be recognizable.

The preferred embodiment proceeds by an analysis of the impulse response functions so as to extract the discrete sound arrival information so as to provide for a better B-format rendering of the impulse response function.

Figure 2:
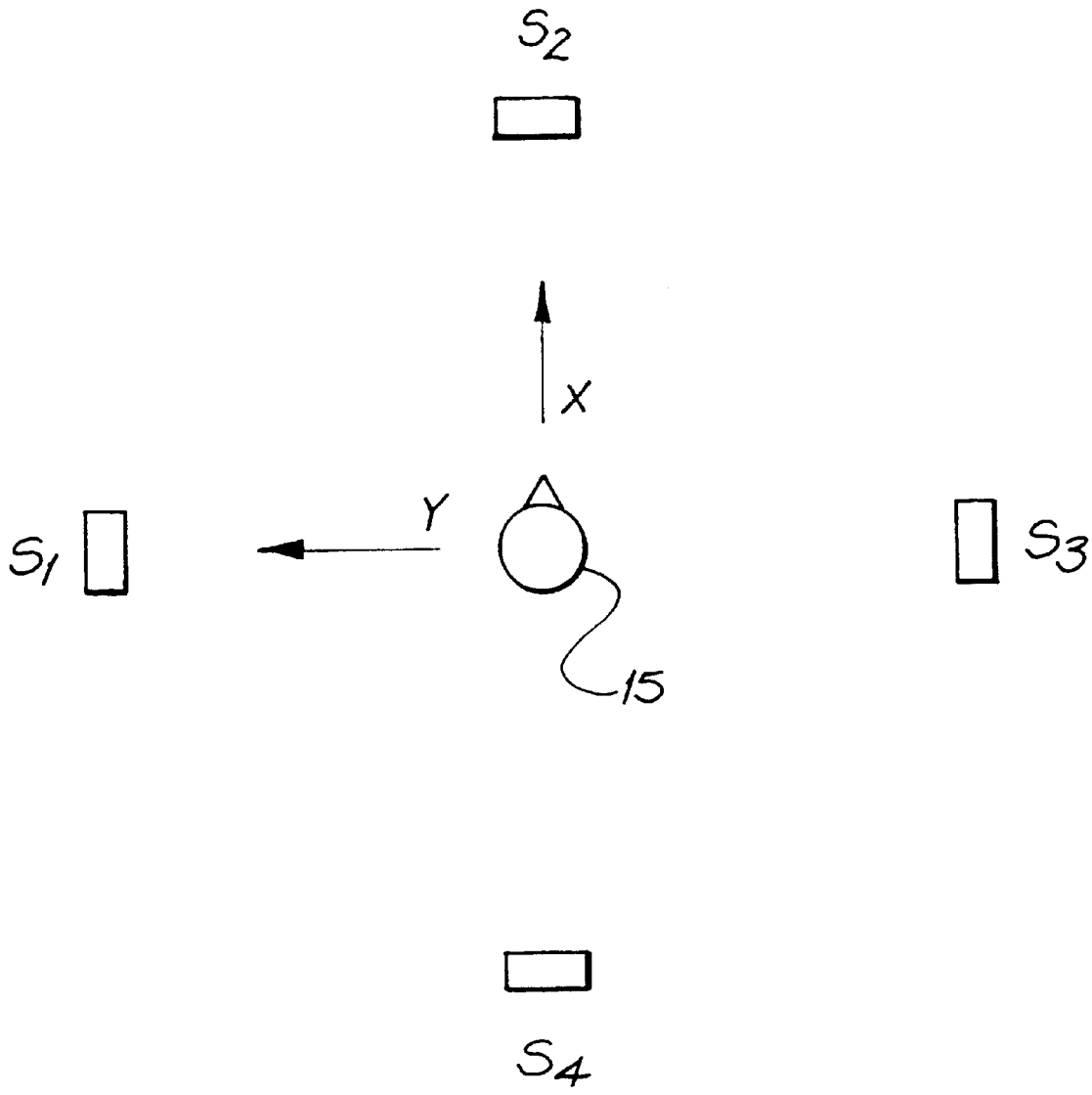
FIG. 2 illustrates an example speaker output array.

It is assumed that playback is to occur on a series of speakers and illustrated in FIG. 2 arranged around a listener 15 with the speakers S1–S4 being arranged so as to provide for simple B-format conversion.

Figure 3:
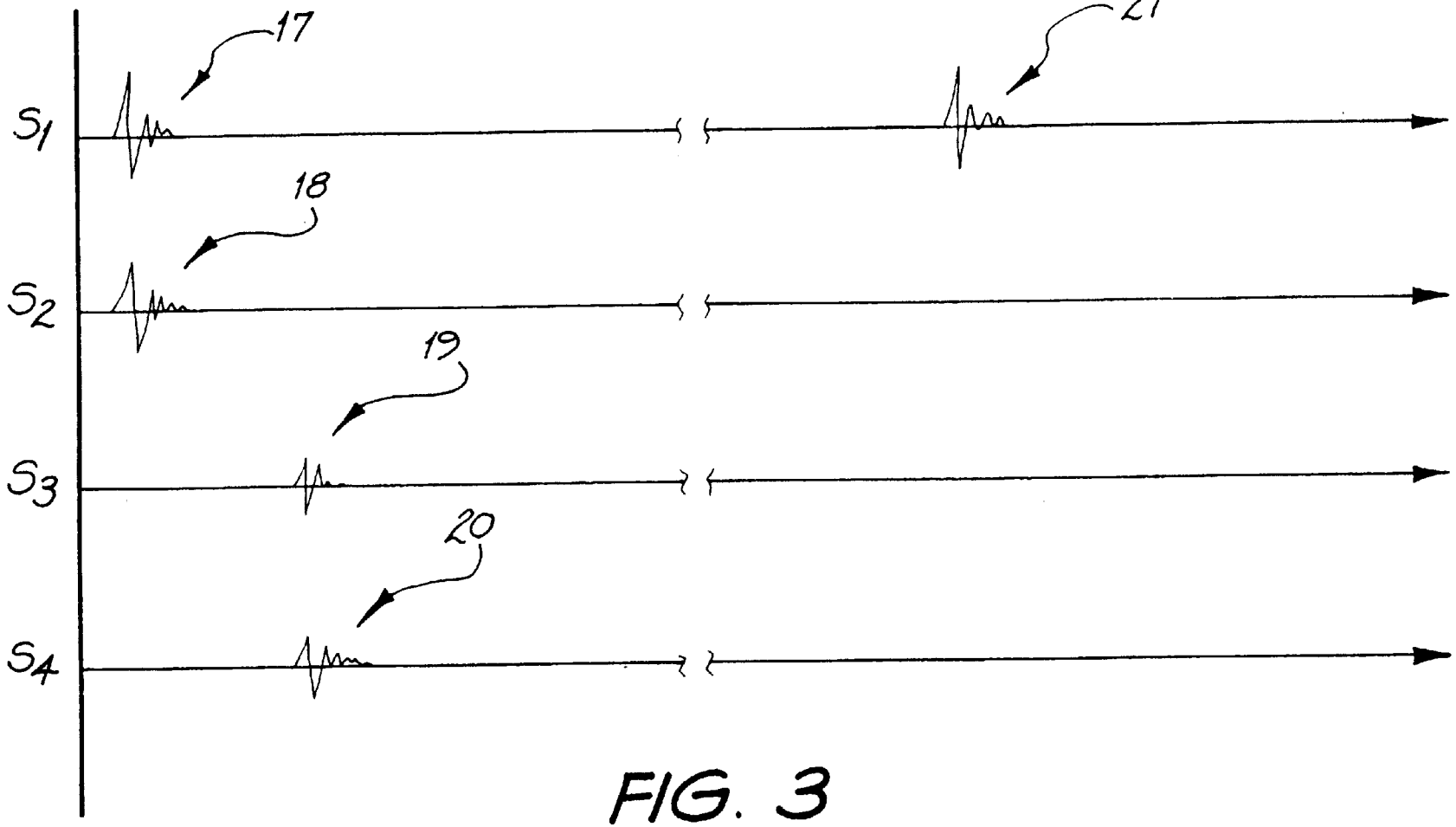
FIG. 3 illustrates the process of extraction of target arrivals and their rendering as a series of speaker impulse responses.
Figure 4:
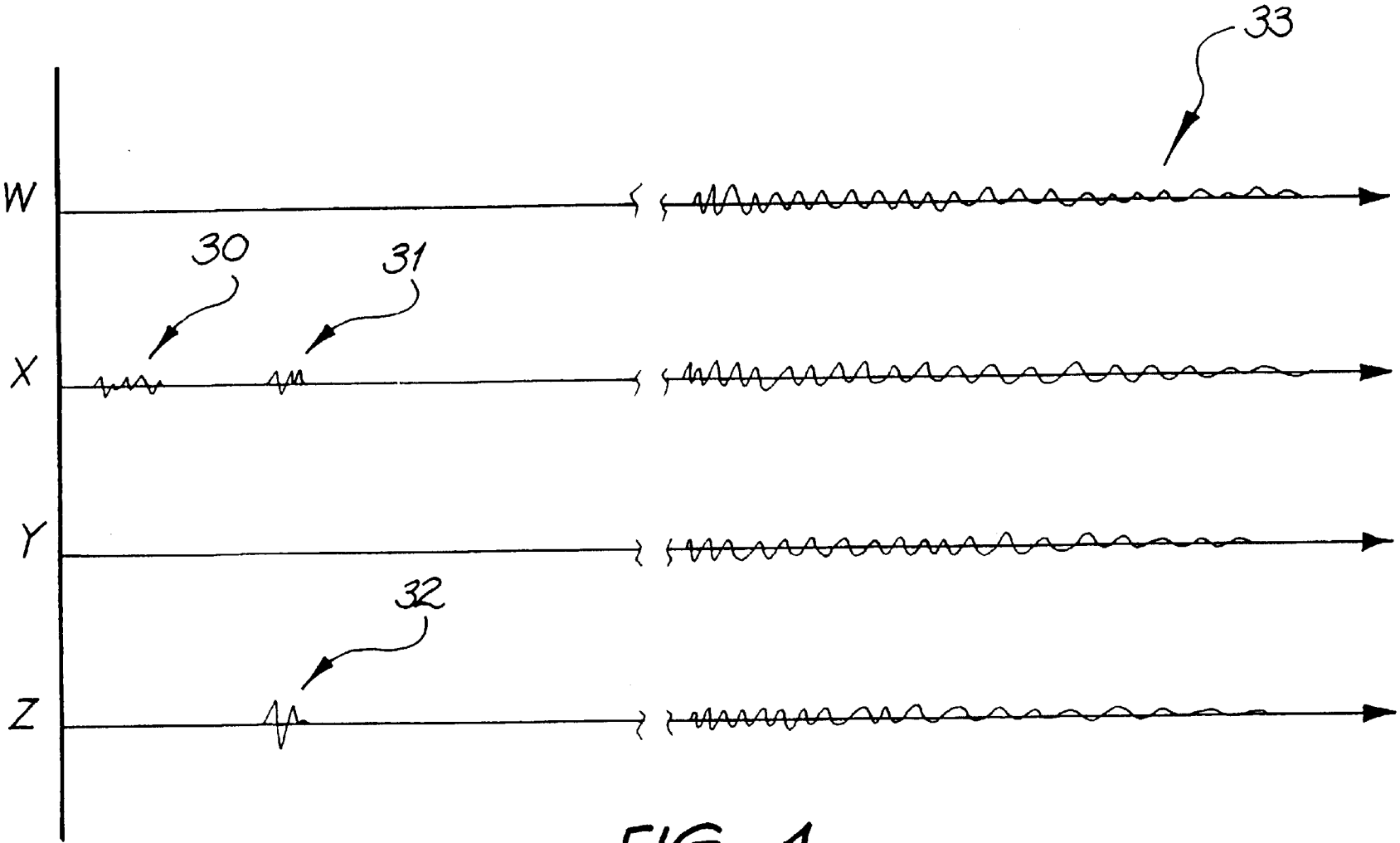
FIG. 4 illustrates a resulting reverberant residual.

Initially, each of the discrete sound arrivals is processed so as to determine a magnitude (W component and direction). This is utilized to determine how to pan the discrete sound arrival between the speakers S1–S4. For example, in FIG. 3, there is shown the corresponding panning 17, 18 of the initial discrete sound arrival of FIG. 1.

Figure 5:
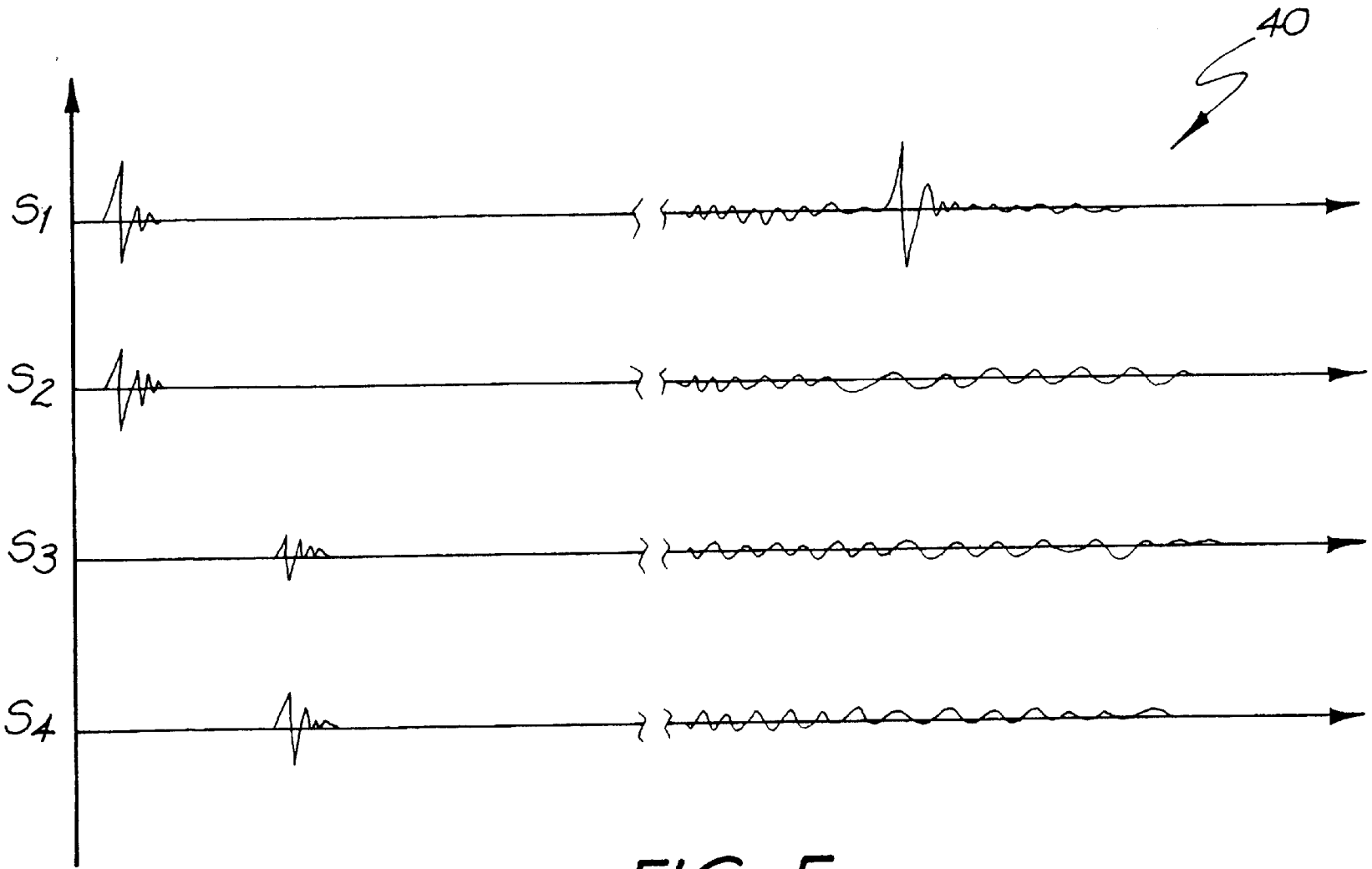
FIG. 5 illustrates the combining of the reverberant residual and speaker arrivals.

Subsequently, the earlier frictions are also processed in the same way so as to produce signals 19, 20. The arrivals detected in the reverberant tail are separately processed so as to produce corresponding arrivals 21. The detected arrivals, as shown by way of example in FIG. 1, are then subtracted out of the B-format signals with the result being as illustrated by way of example in FIG. 3 with the subtraction often leading a number of small residuals eg. 30–32 in the B-format signal. The remaining overall B-formal signal is then utilized as a residual 33 and decoded to the speakers utilizing standard B-format decoding techniques. The separately encoded arrivals (FIG. 3) are then combined with the residuals as illustrated 40 in FIG. 5 so as to provide for impulse responses for each speaker.

It should be noted that, in practice, there is often a large number of identifiable reflections and the figures show a simplified example for clarity of discussion.

Figure 6:
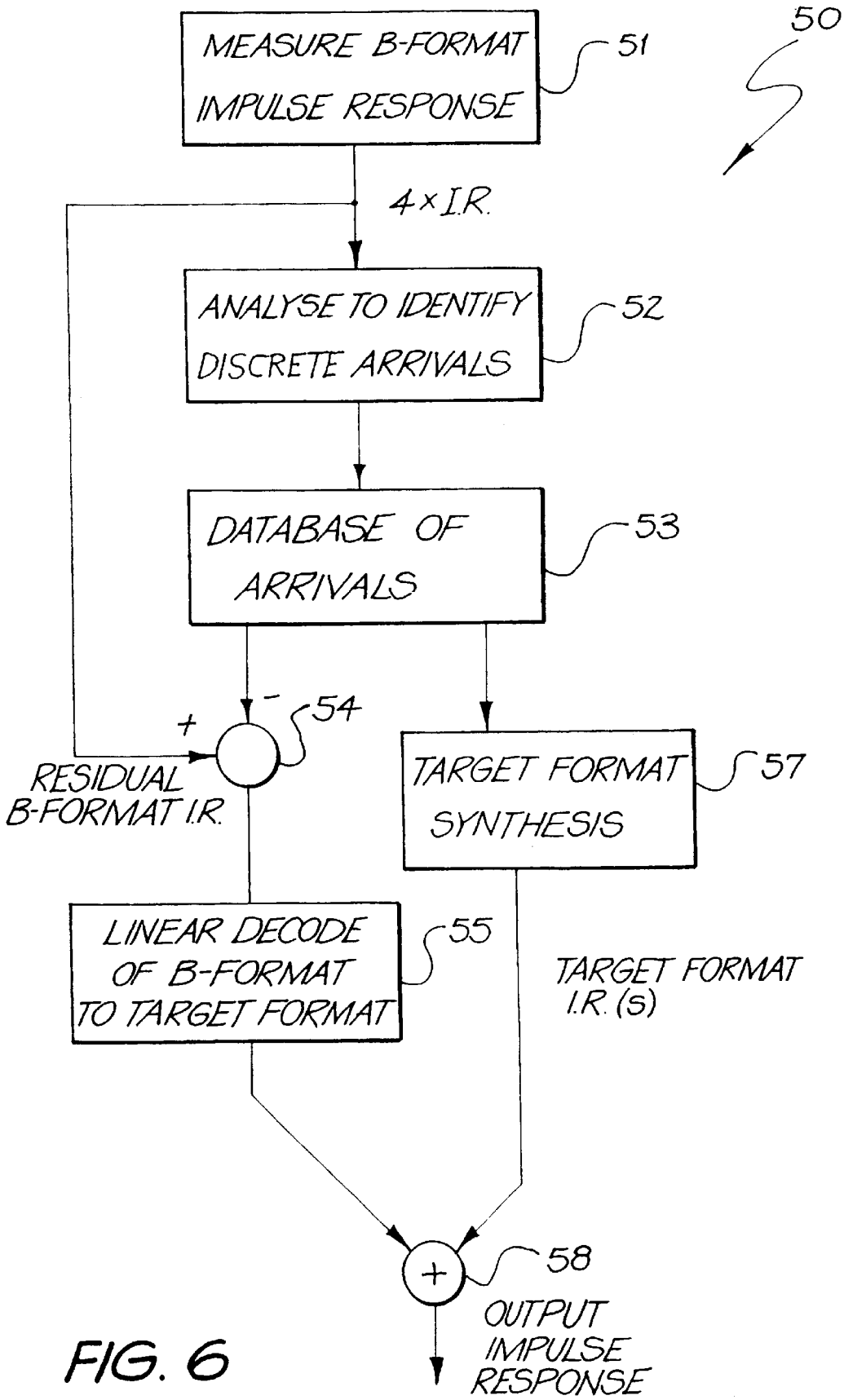
FIG. 6 illustrates the steps of the preferred embodiment.

Turning now to FIG. 6, there is illustrated the steps 50 involved in the preferred embodiment. The steps include the initial measurement of the B-format impulse responses 51 which outputs 4 impulse responses. The impulse responses are analysed 52 to identify discrete arrivals and their likely direction and magnitude. A database of arrivals is determined 53 and utilized firstly, to subtract the arrivals 54 out of the initially measured impulse response functions so as to form a residual B-format impulse response function which is then linearly decoded 55 utilizing standard techniques. The database of arrival 53 is also separately utilized so as to synthesise the detected targets separately on the output speaker array. The two outputs are combined 58 so as to produce combined output impulse response functions for each speaker. The output impulse response functions can then be convolved with an audio signal (in addition to any convolution with speaker equalization functions) so as to produce an enhanced spatialization of an audio source in multiple dimensions.

In a further embodiment, the target format of the impulse response may be a 2-channel binaural format for headphone playback, or a 2-channel cross talk cancelled binaural format for stereo playback.

It would be further appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

We claim:

1. A method for the creation of acoustic impulse responses for utilization in rendering to an array of speakers comprising the steps of:

measuring a room response function;

extracting a series of discrete time arrivals from said measured room response function so as to leave a reverberant residual response function;

separately rendering said extracted series and said reverberant residual response function to said array of speakers to form a discrete response and a residual response;

combining said discrete response and said residual response to form an acoustic impulse response for said array of speakers.

2. A method as claimed in claim 1 wherein said measuring step includes measuring said room response function in a B-format.

3. A method as claimed in claim 1 wherein said extraction step includes extracting a direction and magnitude of each of said discrete time arrivals.

4. A method for the creation of acoustic impulse responses for utilization in rendering to a pair of headphones comprising the steps of:

measuring a room response function;

extracting a series of discrete time arrivals from said measured room response function so as to leave a reverberant residual response function;

separately rendering said extracted series and said reverberant residual response function to said headphones using binaural rendering methods.

5. A method as claimed in claim 4 wherein said binaural rendering includes cross talk cancelling of said rendered signals.

* * * * *